United States Patent [19]

Okabe

[11] Patent Number: 5,038,940

[45] Date of Patent: Aug. 13, 1991

[54] COLLECTIVE PACKING BOX SEPARABLE

[75] Inventor: Masaaki Okabe, Aichi, Japan

[73] Assignee: Okabe Engineering Kabushiki Kaisha, Nagoya, Japan

[21] Appl. No.: 505,370

[22] Filed: Apr. 6, 1990

[30] Foreign Application Priority Data

Apr. 8, 1989 [JP] Japan ..... 1-41297[U]
May 17, 1989 [JP] Japan ..... 1-23478

[51] Int. Cl.[5] ..... B65D 5/54
[52] U.S. Cl. ..... 206/602; 229/120.37
[58] Field of Search ..... 220/23.4; 206/602; 229/120.37

[56] References Cited

U.S. PATENT DOCUMENTS

| | | | |
|---|---|---|---|
| 1,723,021 | 8/1929 | Fagan | 206/602 |
| 2,205,437 | 6/1940 | Ringler | 206/602 |
| 3,252,646 | 5/1966 | Rockefeller | 206/602 |
| 4,040,558 | 8/1977 | Bamburg et al. | 229/120.37 |
| 4,101,034 | 7/1978 | Yamaguchi | 206/602 |
| 4,263,769 | 4/1981 | Hanazawa et al. | 206/602 |
| 4,742,917 | 5/1988 | Bornwasser et al. | 206/602 |

FOREIGN PATENT DOCUMENTS

| | | | |
|---|---|---|---|
| 752178 | 12/1970 | Belgium | 220/23.4 |
| 2623832 | 12/1977 | Fed. Rep. of Germany | 206/602 |
| 2908520 | 9/1980 | Fed. Rep. of Germany | 206/602 |
| 610682 | 10/1960 | Italy | 206/602 |
| 62-95525 | 6/1987 | Japan . | |
| 62-139926 | 9/1987 | Japan . | |
| 63-166920 | 10/1988 | Japan . | |
| 382645 | 9/1964 | Switzerland | 206/602 |

*Primary Examiner*—Gary E. Elkins
*Attorney, Agent, or Firm*—Wenderoth, Lind & Ponack

[57] ABSTRACT

A collective packing box according to the present invention is separable into individual packing boxes in which individual goods are respectively accommodated. The collective packing box includes a group of tubular unit packing box bodies in combination with a cover. Each of the tubular unit packing box bodies has a plurality of sides defining two opposite parallel outer surfaces. The cover includes a plurality of demarcating sections which are separable from one another. Each of the demarcating sections defines a connecting portion at the center thereof, covering portions disposed on opposite sides of the connecting portion, and marginal portions disposed to the outside of the covering portions. The connecting portions are fixed to the group of tubular unit packing box bodies over one of the two opposite parallel outer surfaces. One of the covering portions is folded over respective one ends of the tubular unit packing box bodies and a marginal portion associated therewith is adhered over the other of the two opposite parallel outer surfaces. Once goods are accommodated within the group of tubular unit packing box bodies, the other connecting portions are disposed over the respective other ends of the tubular unit packing box bodies and the marginal portions associated therewith are also adhered over the other of the two opposite parallel outer surfaces. In this way, when the demarcating sections of the cover are separated, a plurality of individual boxes are formed in which the goods are accommodated.

4 Claims, 10 Drawing Sheets

COLLECTIVE PACKING BOX SEPARABLE

BACKGROUND OF THE INVENTION

The present invention relates to a collective packing box separable into individual packing boxes having respective goods accommodated therein.

In industrial fields such as the automobile parts industry, the electric machinery and implement industries, parts are usually packed in a packing box which is partitioned into a dozen spaces for the parts, respectively, and manufacturers ship the thus packed parts to the market.

Provided that some machines are manufactured by incorporating a specific part therein, some manufacturers purchase such specific parts in large quantities.

Since the specific parts to be supplied to users are packed in a temporary packing box there is a disadvantage in that the packing box is liable to be damaged or the parts are liable to fall out of the box.

Furthermore, although it is indispensable to the users for a specification of parts, a trademark, or the model of the parts to appear on the packing box for accommodating a dozen parts, such an identification of the parts cannot be maintained with the parts when separated into individual parts. It would be advantageous to maintain an identification of the parts with individual ones of the parts since it is also a current tendency for general consumers as well as for those in industry to purchase and consume a small number of parts.

Incidentally, it is known that food and drink for one person is often packed in an individual unit for purchase by students residing away from home, people on travel, or people with a small family, etc.

SUMMARY OF THE INVENTION

Accordingly, it is an object of the present invention to provide a collective packing box separable into individual packing boxes having one unit of a product accommodated therein to meet the needs referred to above.

To achieve the above object, the present invention comprises a group of tubular unit packing box bodies having an even number of sides so as to have a square or hexagonal cross section, for example, two of said sides defining parallel opposite surfaces thereof, and a cover comprising demarcating sections on a sheet corresponding to the number of unit packing box bodies, separating means such as perforations formed between the demarcating sections on the sheet, connecting portions corresponding to the unit packing box bodies and provided substantially at the center of the demarcating sections, bottom covering portions corresponding to respective ones of the openings of the unit packing box bodies and defined to one side of the connecting portions, marginal portions defined to the outside of the bottom covering portions, top covering portions corresponding to the respective other ones of the openings of the unit packing box bodies and defined to the other side of the connecting portions, and marginal portions defined to the outside the covering portions, wherein one of the opposite surfaces of each of the unit packing box bodies is adhered to the connecting portions, the bottom covering portions of the cover are bent toward the other respective ones of the openings of the unit packing box bodies, and the marginal portions defined to the outside of the bottom covering portions are adhered to the other of the opposite surfaces of each of the unit packing box bodies.

The goods to be packed are accommodated in the unit packing boxes, respectively, the top covering portions of the cover are bent to close the respective other ones of the openings of the unit packing boxes and the marginal portions defined to the outside of the top covering portions are adhered to the other of the opposite surfaces of each of the unit packing box bodies.

The present invention can also comprise a collective packing box body composed of a group of tubular packing boxes having sides defining parallel opposite surfaces thereof, the box bodies arranged in parallel columns, a respective base sheet adhered to one or both of the opposite surfaces of the group of unit packing box bodies, each base sheet provided with separating means disposed between adjoining unit packing box bodies, wherein a base sheet of the collective packing box body is adhered to the connecting portions, the bottom covering portions of the cover are bent toward respective ones of the openings of the unit packing boxes, and the marginal portions defined to the outside of the bottom covering portions are adhered to another base sheet of the collective packing box body or a surface thereof.

The goods to be packed are accommodated in the unit packing boxes bodies, respectively, the top covering portions of the cover are bent toward the respective other ones of the openings of the unit packing boxes and the marginal portions defined to the outside of the top covering portions are adhered to the base sheet of the collective packing box body or a surface thereof.

The collective packing box having the structure set forth above can be separated into individual packing boxes accommodating the goods individually therein by manually tearing off each unit of a cover covering the periphery of a unit packing box along separating means.

DETAILED DESCRIPTION OF THE PREFERRED EMBODIMENTS

Figure 1:
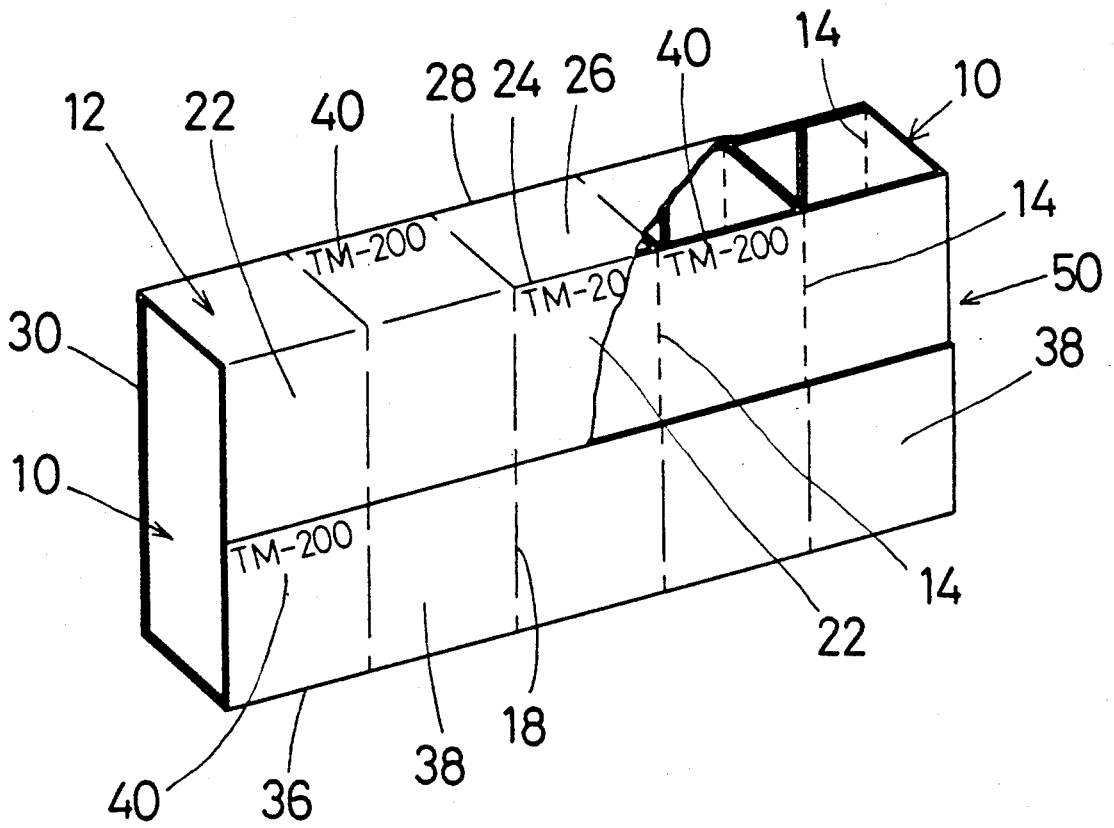
FIG. 1 is a partly cutaway perspective view of a first embodiment of a collective packing box according to the present invention.

A first embodiment of the present invention will be described with reference to FIGS. 1 to 6.

In a group of unit packing box bodies 10, each of the box bodies 10 individually accommodates a unit of goods, for example, a piece of an automobile spark plug. The unit packing box bodies 10 are connected in parallel with each other continuously by a cover 12 so as to form a group of unit back box bodies. The cover 12 is separable into demarcating sections 20 respectively associated with each unit packing box body 10 so that each unit packing box body 10 accommodating the goods therein can be separated with one demarcating section 20 of the cover 12.

The unit of goods which can be packed in each box body 10 refers not only to a piece of a part but also to small parts or items of food accommodated in a small bag.

The first embodiment is capable of accommodating therein a plurality of goods arranged laterally in one column.

Although five unit packing boxes 10 for accommodating five units of goods are shown with respect to the first embodiment, the number of box bodies is not limited thereto and can be varied depending on the commercial needs of customers.

The present invention is fundamentally composed of tubular unit packing box bodies 10 in combination with a cover 12 for covering the periphery of the group of tubular unit packing box bodies 10.

Figure 3:
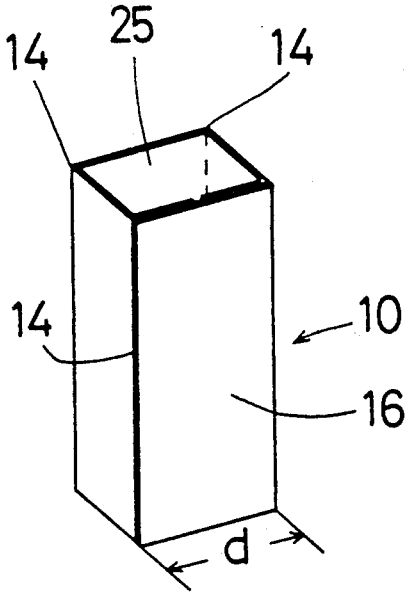
FIGS. 3 to 5 are perspective views, respectively, of various unit packing box bodies in the present invention.
Figure 4:
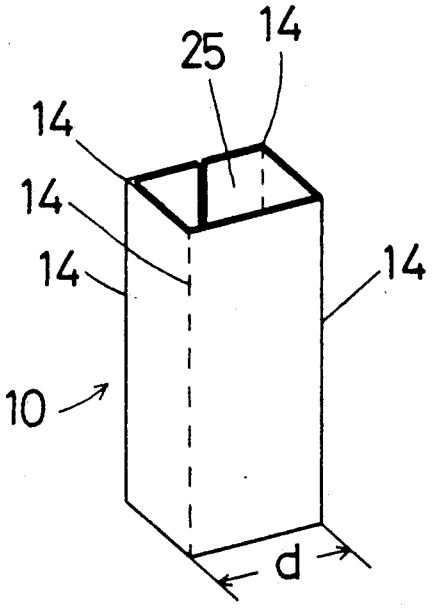

Each unit packing box body 10 has, as illustrated in FIGS. 3 and 4, a rectangular tubular shape four corners of which are folded along perforations and the upper and the lower ends of which define openings denoted at 25.

Materials for forming the unit packing box bodies generally can include craft paper, so-called milk-carton paper, cardboard or a sheet of transparent or non-transparent plastic.

According to the first embodiment, since a group of unit packing box bodies 10 is intended to be foldable for reasons discussed later, the four corners of each unit packing box body are provided with perforations 14 about which the box bodies can be bent with ease.

However, the perforations need not be provided if the group of packing boxes is not intended to be foldable.

If the unit packing box body 10 is made of a hard plastic sheet, the group of packing box bodies cannot be folded but the present invention still satisfactorily solves the problems associated with the prior art.

The unit packing box body 10 shown in FIG. 3 comprises a paper sheet which is folded in a square tubular shape and a sheet 16 adhered to one side of the paper sheet.

The adhesion of the sheet 16 with paste to the paper sheet increases the strength of the unit packing box body 10 and allows connecting portions 30 of the cover 12 to be adhered to the box bodies 10 with ease.

However, inasmuch as the unit packing box body 10 is not used as a separate unit but is used with the cover 12 as described later, even if the sheet 16 is not adhered to the unit packing box body 10 the tubular unit packing box body 10 can be used. Furthermore, both the process in which the sheet 16 is adhered with paste to the paper sheet and the material cost of the sheet 16 can be respectively omitted which contributes to a reduction in the manufacturing cost.

It is thus to be understood by those of ordinary skill in the art that the sheet 16 is not essential to the invention.

Since the unit packing box body 10 has openings at upper and lower ends, respectively, a group of such packing boxes does not have covered ends. Hence, a means to complete the group of five independent unit packing box bodies 10 is required.

Although each of the unit packing box bodies as illustrated in FIGS. 3 and 4 is square, the unit packing box is not limited to being square but may have a honeycomb-shape (FIG. 5) or hexagonal cross section. The honeycomb-shape is desirable depending on a particular shape of the goods to be packed.

It is only necessary that the parallel opposed sides of the unit packing box bodies function to provide surfaces along which paste can be applied as explained later. Hence, the shape of the cross section of the unit packing box body 10 is not essential to the invention.

It is also possible to form a unit packing box body by pasting a sheet 16 to both sides of the tubular body.

In order to realize the usefulness of the group 50 of packing boxes as a collective packing box, the ability to separate the group 50 with ease is required.

Figure 2:
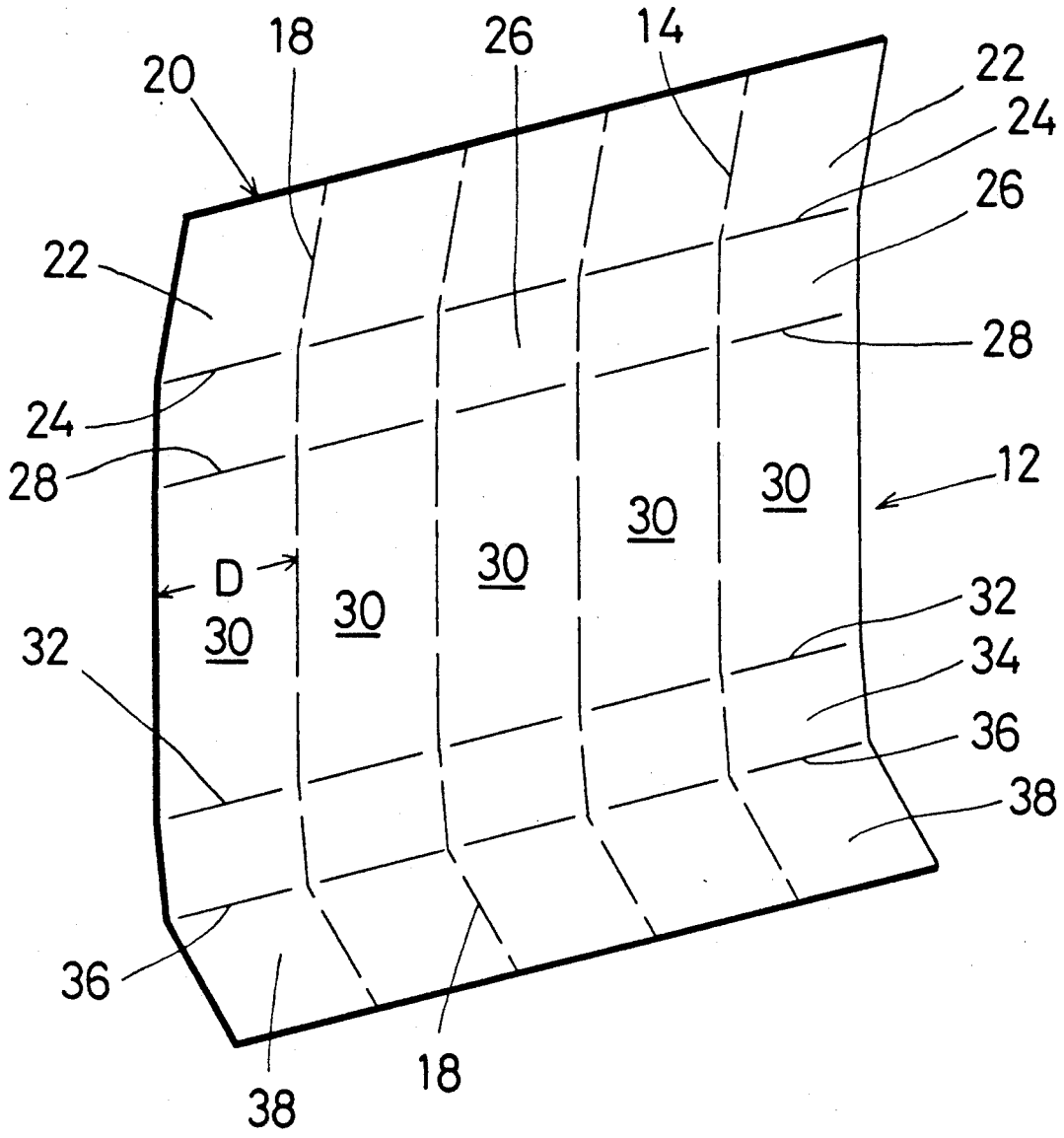
FIG. 2 is a perspective view of a cover of the present invention.

Consequently, a cover 12 as illustrated in FIG. 2 is provided according to the first embodiment.

The cover 12 is commonly employed in the second and third embodiments as described hereinafter.

The structure and function of the cover 12 will be explained briefly. The cover 12 is provided with top covering portions 26 and bottom covering portions 34 for closing the openings 25 at both ends of the unit packing box bodies 10, connecting portions 30 for physically connecting five independent unit packing box bodies 10, and separating means 18 for separating the group of packing box bodies 10 into the individual small boxes of each group.

More specifically, four separating means 18 are defined at predetermined intervals on the square sheet made of a piece of paper or plastic, corresponding to the number of unit packing box bodies 10, in order to facilitate the separation of the cover 12 with ease into five demarcating sections 20 disposed side to side.

Accordingly, five demarcating sections 20 are defined on the cover 12 by the four separating means 18 and both ends of the cover 12.

The separating means 18, which are well known per se to those of ordinary skill in the art, comprise slender notches having predetermined lengths and linking portions provided between the notches.

Other applicable separating means include perforations or so-called jipper notches having a C shape which are spaced a predetermined interval from one another. Alternatively, the separating means may comprise a seal member made of slender tape attached to adjoining demarcating sections wherein the seal member can be pulled off at the time of use.

The width D of the demarcating section 20 to be partitioned by the separating means 18 corresponds to a width d of the unit packing box 10.

However, the width D may be slightly greater than the width d of the unit packing box body 10. If the width D is less than the width d, it is difficult to separate the group into individual unit packing boxes. Hence, it is preferable that the width D be substantially the same or slightly greater than the width d.

Figure 5:
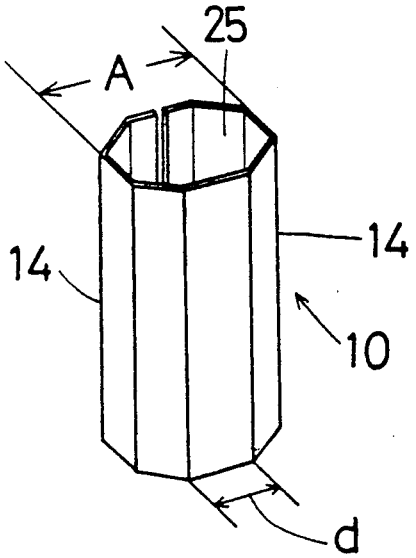

In the unit packing box 10 having the honeycomb structure shown in FIG. 5, the width d of a surface over which paste is applied is less than a maximum width A of the unit packing box body 10, and the width D of the connecting portion 30 of the cover 12 may correspond to the maximum width A of the unit packing box body 10.

Marginal portions 22 of the cover 12 to which paste is applied, referring to FIG. 1, are adhered to one end of surfaces at one side of the unit packing box bodies 10, whereas marginal portions 38 are adhered to the other end of said surfaces.

Covering portions 26, 34 constituting end covers for the unit packing box bodies 10 are provided between folds 24, 28 and 32, 36 provided perpendicularly to the separating means 18.

Accordingly, the shape and size of the covering portions 26, 34 preferably correspond to the size of the openings 25 of the unit packing box bodies.

The connecting portions 30, extending between opposite covering portions 26, 34, for physically connecting five independent unit packing box bodies correspond to the shape and size of the other sides of the unit packing box bodies 10 (rear surfaces of the unit packing box bodies as illustrated in FIGS. 3 to 5). These connecting portions 30 are defined between fold lines 28, 32 provided perpendicular to the separating means 18.

Figure 6:
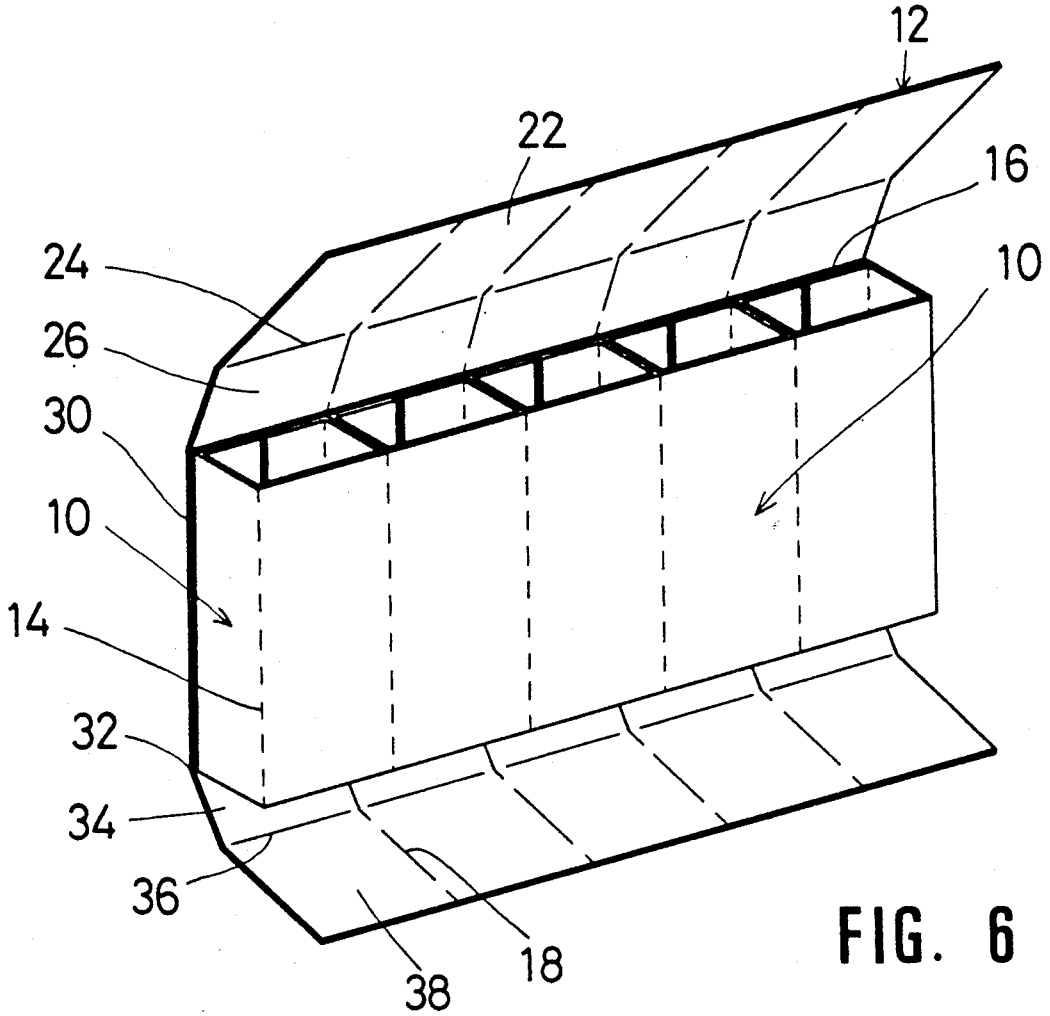
FIG. 6 is a perspective view showing a state in which the cover is combined with the unit packing box bodies.

These connecting portions 30 constitute, as evident with reference to FIG. 6, adhesive-receiving portions to which the other sides of the independent unit packing box bodies 10 are adhered. Five connecting portions 30 and five unit packing boxes are connected to each other in a collective state.

In the figures, the marginal portions 22 and 38 formed at both sides of the cover 12 are substantially the same and are adhered to the same side of the unit packing box bodies 10. Hence, the length of the marginal portions 22 (distance from the sides of the cover 12 to the fold lines 24 in FIG. 2) can be short and the length of the marginal portions 38 may be long as long as the total of these lengths is substantially equal to the length of said same side of each of the box bodies 10.

However, the function of the marginal portions 22, 38 is not affected at all even if the lengths of the marginal portions 22, 38 are shorter than the illustrated lengths.

The manner in which the above-described embodiments of the invention are assembled will now be described.

One side or the other side of each of the unit packing box bodies 10 formed independently is adhered to a respective one of the connecting portions 30 which are previously formed as respective parts of the demarcating sections 20 of the cover 12.

In this respect, the adhesive may be applied to only the unit packing box bodies 10 or to both the connecting portions 30 and the unit packing box bodies 10.

FIGS. 1 and 6 illustrate embodiments in which the sheet 16 is adhered to the sides of the box bodies 10 which are covered by the marginal portions 22, 38, but the sheet 16 may be adhered to the other sides of the box bodies which are covered by the connecting portions 30.

In the unit packing box bodies 10 as illustrated in FIGS. 4 and 5 having no sheet 16 adhered to respective one sides thereof, differing from the embodiment of FIG. 3, it is sufficient to adhere the portions of the unit packing box bodies 10 terminating at confronting edges to the connecting portions 30.

At this time, if the unit packing box bodies 10 are provided with the perforations 14 at the four or six corners thereof, the five unit packing box bodies 10 can be bent into a flat configuration so that adhesive can be applied to the connecting portions 30 and the unit packing box bodies 10 can be pressed against the connecting portions 30 while in a flat configuration, which facilitates the production process.

Accordingly, the five unit packing box bodies 10 are connected to each other so as to assume a collective state on the connecting portions 30 of the cover 12.

To close the bottom ends of the unit packing box bodies 10, the cover 12 is bent along the fold line 32, which is one boundary of the connecting portions 30, so that respective ones of the openings 25 of the unit packing box bodies 10 (the lower openings in FIGS. 3–6) are closed by the covering portions 34 to define the bottoms of completed boxes.

Thereafter, the marginal portions 38 are bent toward the unit packing box bodies 10 along the fold line 36 and the marginal portions 38 are adhered to the sides, facing front in the figures, of the unit packing box bodies 10.

With the arrangement set forth above, a collective packing box 50 is substantially completed according to the invention.

The manufacturers of the collecting packing box supply the collective packing box as substantially completed to users who then pack the goods in the unit packing box bodies 10. A more detailed explanation follows.

The goods to be packed are accommodated one by one in the unit packing box bodies 10 and then the covering portions 26 of the cover 12 are bent toward the unit packing box bodies 10 along the fold line 28 provided adjacent the connecting portions 30.

Accordingly, the covering portions 26 close the respective other ones of the openings 25 of the unit packing box bodies 10 (the upper openings in FIGS. 3–6).

To prevent a release of the covering portions 26, the marginal portions 22 are bent toward the unit packing box bodies along the fold line 24 and are adhered to the sides of the unit packing boxes 10 with adhesive (FIG. 1).

The assembly is thus completed also according to the present invention.

As illustrated in FIG. 1, there may be provided indicating portions 40 whereat a specification of the goods to be packed, a trademark, a model of the goods etc. appear, as respective parts of the demarcating sections 20 of the cover 12 or as respective parts of the unit packing box bodies 10.

By providing the indicating portions 40, even if the collective packing box 50 is separated into individual boxes, there is an advantage that the customers can confirm the specification, etc. of the goods packed within each box with certainty.

Although the specification of the goods appears at the outside of the collective packing box 50 which collectively accommodates the goods, there is no likelihood that the specification will be made indistinct when the box is separated into units.

It is also contemplated to enclose the specification describing the details of the goods in each unit of the collective packing box 50.

Figure 9:
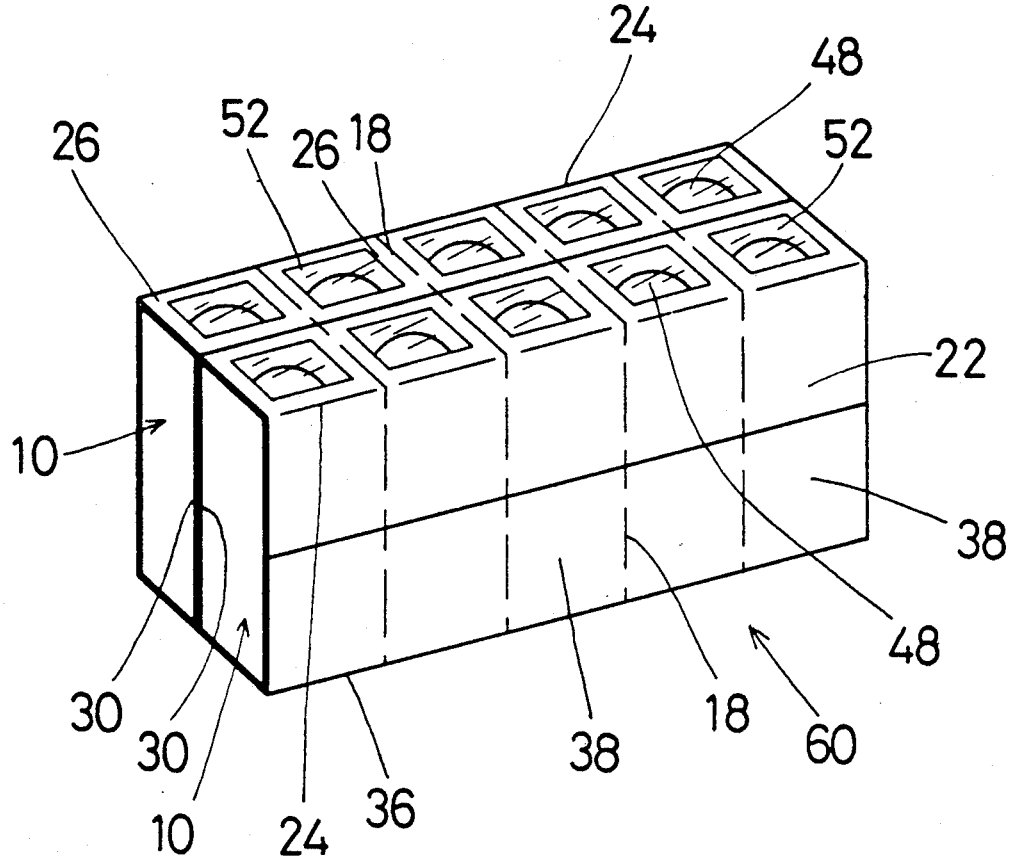
FIG. 9 is a perspective view of a modified version of the second embodiment.
Figure 10:
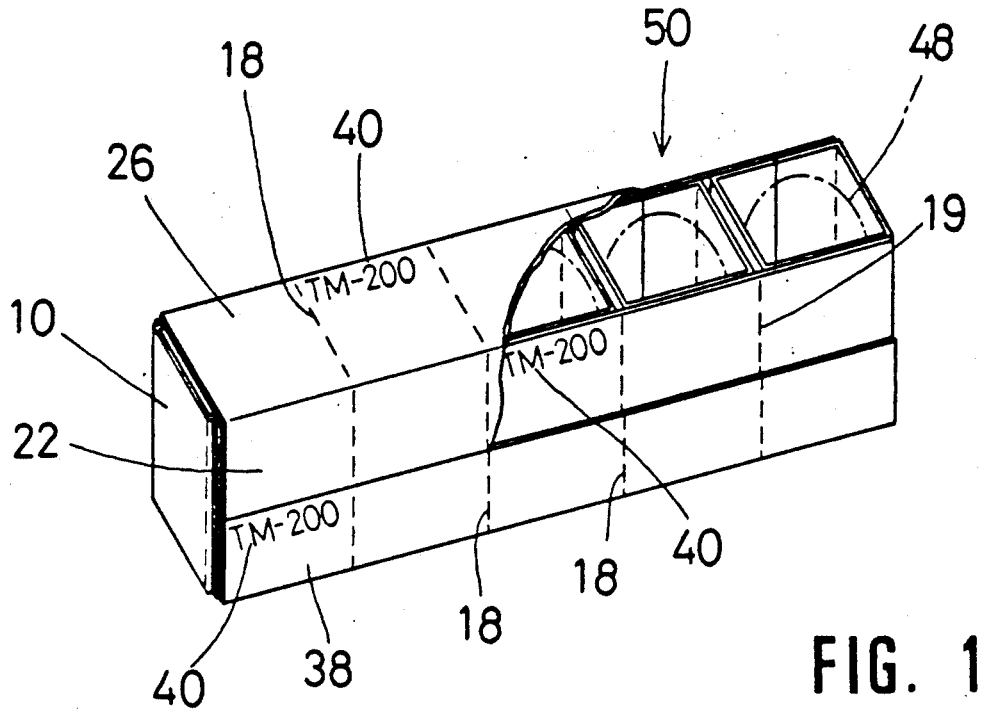
FIG. 10 is a partly cutaway perspective view of a third embodiment of a collective packing box according to the present invention.
Figure 11:
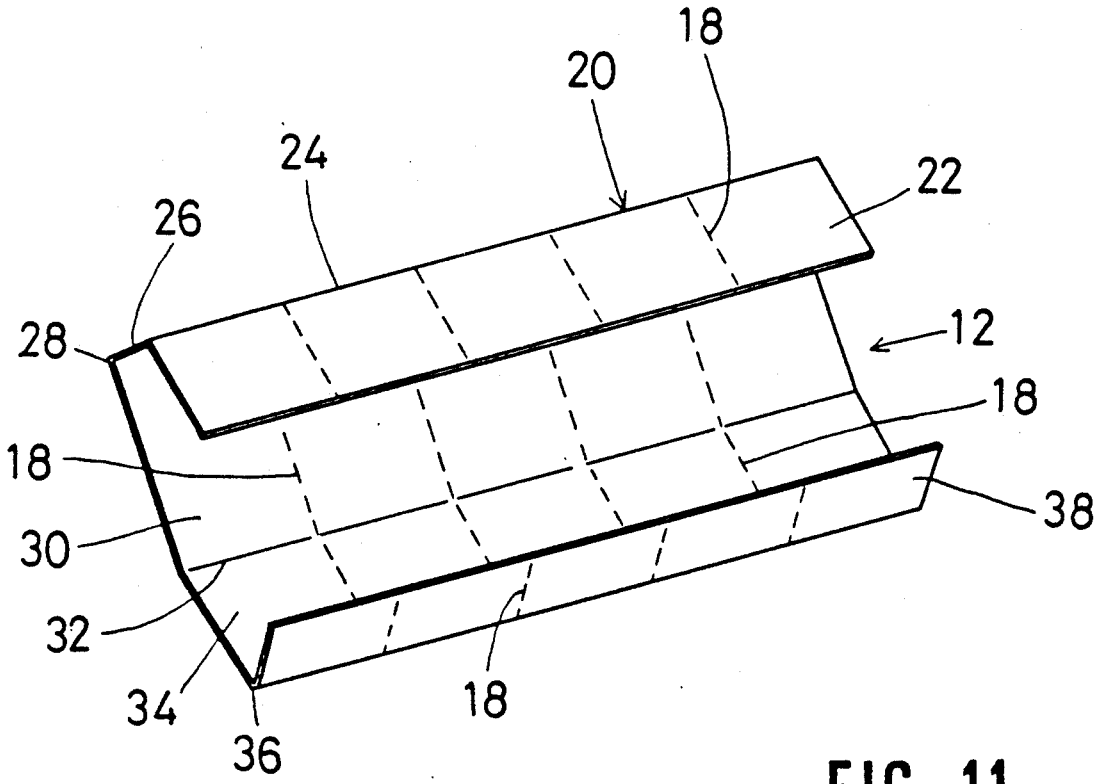
FIG. 11 is a perspective view of a cover of the third embodiment.

It is also thus contemplated to provide notched portions 52 in the covering portions 26 of the cover 12 so that the goods 48 packed can be seen through openings defined by such notched portions 52 or transparent sheets attached to the notched portions (refer to FIG. 9 showing such features in association with a second embodiment of the invention).

Figure 7:
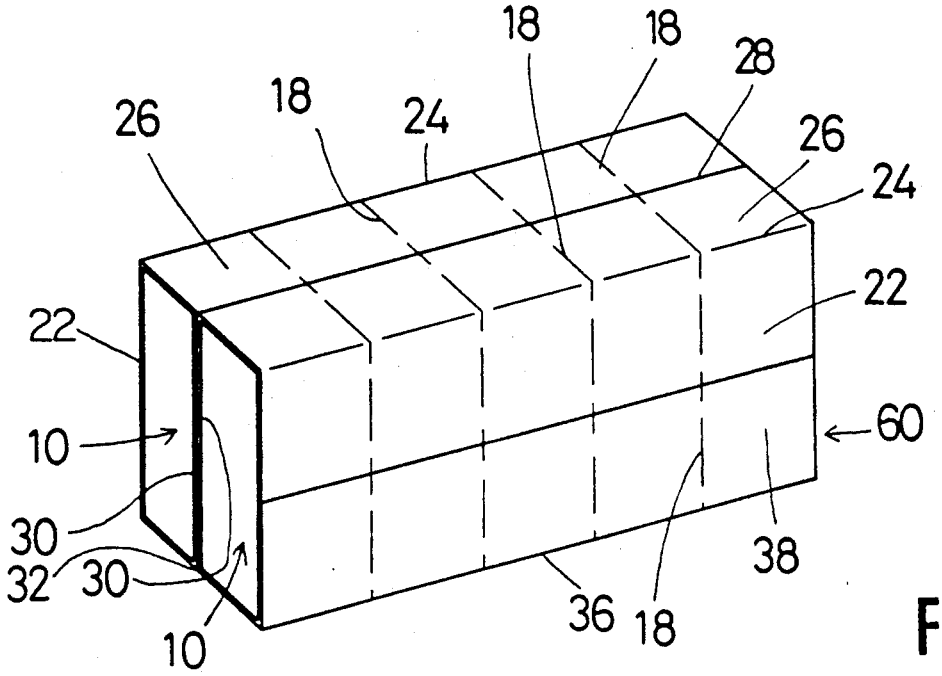
FIG. 7 is a perspective view of a second embodiment of a collective packing box according to the present invention.
Figure 8:
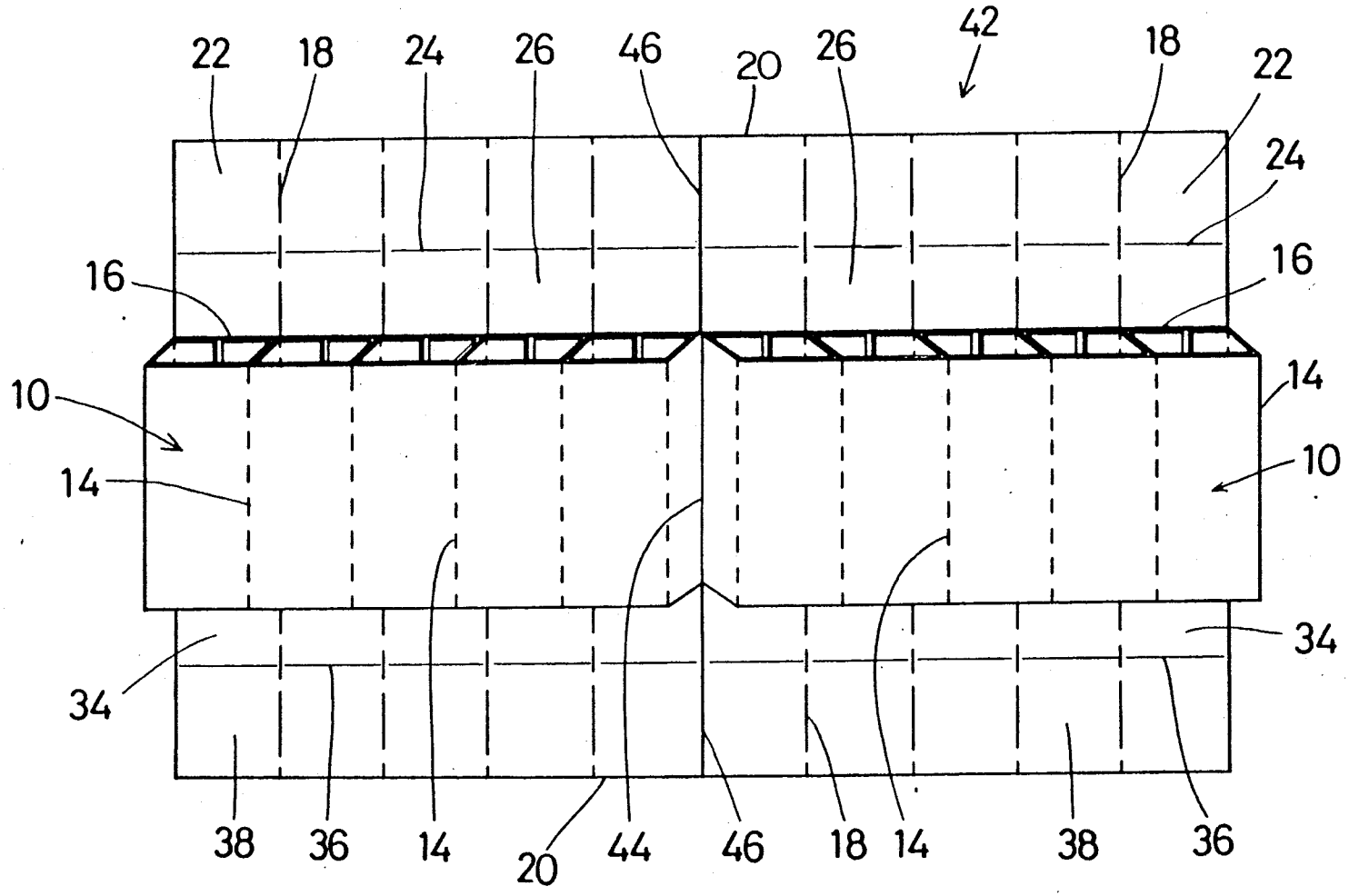
FIG. 8 is a perspective view showing a state in which the cover is combined with the unit packing box bodies in the second embodiment.

The second embodiment is illustrated in FIGS. 7 to 9.

This embodiment is substantially similar to the first embodiment but is provided with two groups of unit packing box bodies disposed in parallel.

First, inasmuch as the structures of the unit packing box bodies 10 are substantially the same as those of the unit packing box bodies 10 in the first embodiment, a detailed explanation thereof is omitted for the sake of brevity.

Regarding the cover 42, since there is a substantial similarity between the structure of the cover 42 and the structure of the cover 12 of the first embodiment, a detailed explanation of the portions common to the cover 12 of the first embodiment and the cover 42 of the second embodiment is omitted and like parts are designated with like reference numerals.

Briefly, the cover 42 of this embodiment corresponds to two covers 12 of the first embodiment (refer to FIG. 8).

In the cover 42 of this embodiment, the connecting portions 30 of the two centrally located demarcating sections 20 are separated by a fold line 44.

In other words, the cover 42 can be likened to connecting portion 30 at an end of a cover 12 of the first embodiment being connected to the connecting portion 30 at an end of another cover 12.

Thus, between the centrally located demarcating sections 20 there is not provided a separating means 18 of the first embodiment. Rather, slits 46 are provided for facilitating the separation of the unit packing boxes 10 at the centrally locating demarcating sections 20.

As is evident from the drawings, the unit packing box bodies 10 are adhered to the connecting portions 30 of the cover 42.

Adhesive is applied to ten connecting portions 30 formed as part of the demarcating sections 20 of the cover 42. Then, one side of the ten unit packing boxes 10 which are manufactured independently are adhered to the ten connecting portions 30.

It will be of course understood very easily that the adhesive can be applied to only the unit packing box bodies 10 or to both the connecting portions 30 and the unit packing box bodies 10.

In FIG. 8, the unit packing box bodies 10 have a sheet 16 adhered to the surface thereof at which surface side edges of the box bodies 10 confront, and which sheet 16 is adhered to the connecting portions 30.

It is of course possible to adhere the other sides of the box bodies 10, opposite to the sides having the sheet 16 adhered thereto, to the connecting portions 30.

Further, unit packing box bodies 10 as shown in FIG. 4 and 5 may be employed and the sheet 16 is omitted, whereby both portions of each of the unit packing box bodies 10 having the confronting side edges are adhered to the connecting portions 30.

If the unit packing box bodies 10 have the perforations 14 at four or five corners thereof, the ten unit packing box bodies 10 can be bent into a flat configuration so that adhesive can be applied to the connecting portions 30 and the unit packing box bodies 10 can be pressed in a flat configuration and adhered to the connecting portions 30, which contributes to the ease of the production process.

Hence, the groups of the ten packing box bodies 10 assume a collective state on the connection portions 30 of the cover 42 in which the boxes 10 are connected to each other (FIG. 8).

To close the bottom ends of the unit packing boxes, the cover 42 is bent along the fold line 32, provided at the boundaries between the connecting portions 30 and the covering portions 34, to close respective ones of the openings 25 of the unit packing boxes 10 (the lower openings in the figures) thereby constituting the bottoms of the completed boxes.

Then, the marginal portions 38 are bent toward the unit packing box bodies 10 along the fold line 36 provided at the boundaries between the covering portions 34 and the marginal portions 38, so that the marginal portions 38 can be adhered to the lower portions of the sides of the box bodies 10 as shown in the figures.

With the arrangement set forth above, a collective packing box 60 is substantially completed according to the present invention.

The packing box manufacturers supply the packing box as substantially completed to users who then pack the goods 48 (refer to FIG. 9) in each unit packing box body 10.

The cover 42 is bent along the fold line 44 between the upper and the lower sets of slits 46 such that two sections of the cover 42 are bent toward one another at the side thereof opposite the unit packing box bodies 10.

Thus, a collective packing box is formed of five unit packing box bodies 10 connected to another five unit packing box bodies 10 at an outer side of the two sections of the cover 42.

Although the two sections of the cover 42 are brought into contact with each other at an inner side of the cover 42, the sections are maintained in a free state not adhered to one another with adhesive.

If the two sections of the cover 42 are adhered, the unit packing box bodies cannot be individually separated.

Each good 48 to be packed is accommodated in a respective one of the ten unit packing box bodies 10 disposed at both sides of the two sections of the folded cover 42. The covering portions 26 of the cover 42 are bent toward the unit packing box bodies 10 along the fold line 28 provided at the boundaries adjoining the connecting portions 30.

The covering portions 26 close the other openings 25 of the unit packing box bodies 10 (upper openings in the figures) thereby constituting tops.

To prevent a release of the covering portions 26, the marginal portions 22 are bent toward the unit packing boxes along the fold line 24 and are adhered to the respective one of the sides of the unit packing box bodies 10 with adhesive. (FIG. 7).

Although the provision of the slits 46 at both sides of the cover 42 was already explained previously, it will be understood that each of two sections of the marginal portions 22, the covering portions 26, the covering portions 34, and the marginal portions 38 can be bent individually in different directions due to the separation thereof by slits 46.

The assembly is thus completed also according to the present invention.

The advantages of this embodiment resides in that the packing boxes are arranged in parallel in two columns. The likelihood of the groups of packing boxes in each column unfolding into one column along the fold line 44 is prevented by both groups of packing boxes being temporarily fastened with a rubber band or an adhesive tape. The rubber band or the adhesive tape are removable so that the packing box bodies can be separated into units with ease.

As in the first embodiment illustrated in FIG. 1, indicating portions, whereat a specification of the goods 48 to be packed, a trademark or a model of the goods appear, are provided as respective parts of the demarcating sections 20 of the cover 42 or respective parts of the unit packing box bodies 10. It is also contemplated that the specification describing the details of the goods be enclosed in each unit of the unit packing boxes.

Also, as in the first embodiment, notched portions 52 may be provided by notching parts of the covering portions 26 of the cover 42 so that the goods 48 can be seen through openings defined by the notching portions 52 or through transparent sheets attached to the notched portions.

A third embodiment of the present invention will be described in detail with reference to FIGS. 10 to 13.

The embodiment is a combination of the cover 12 and a collective packing box body 13 in which a plurality of the unit packing box bodies 10 assume a collective state.

The cover 12 has the same structure as that of the first embodiment set forth hereinabove.

The unit packing box bodies 10 constituting the collecting packing box body 13 have the same structure as those of the first embodiment.

Accordingly, the detailed description of the cover 12 and the unit packing box bodies 10 made with respect to the first embodiment is applicable to the third embodiment and is thus omitted here.

The collecting packing box body 13 comprises five unit packing box bodies 10 each having surfaces for receiving paste at opposed sides thereof and perforations 14 at four corners, base sheets 11 adhered to the boxes, and separating means 19 such as perforations along demarcating lines of the sheets 11. The separating means 19 are disposed between adjacent unit packing box bodies 10.

Each of the separating means 19 provided at the base sheets 11 at both sides of the group of unit packing box bodies 10 is intended to be associated with a respective one of the unit packing box bodies 10.

Figure 12:
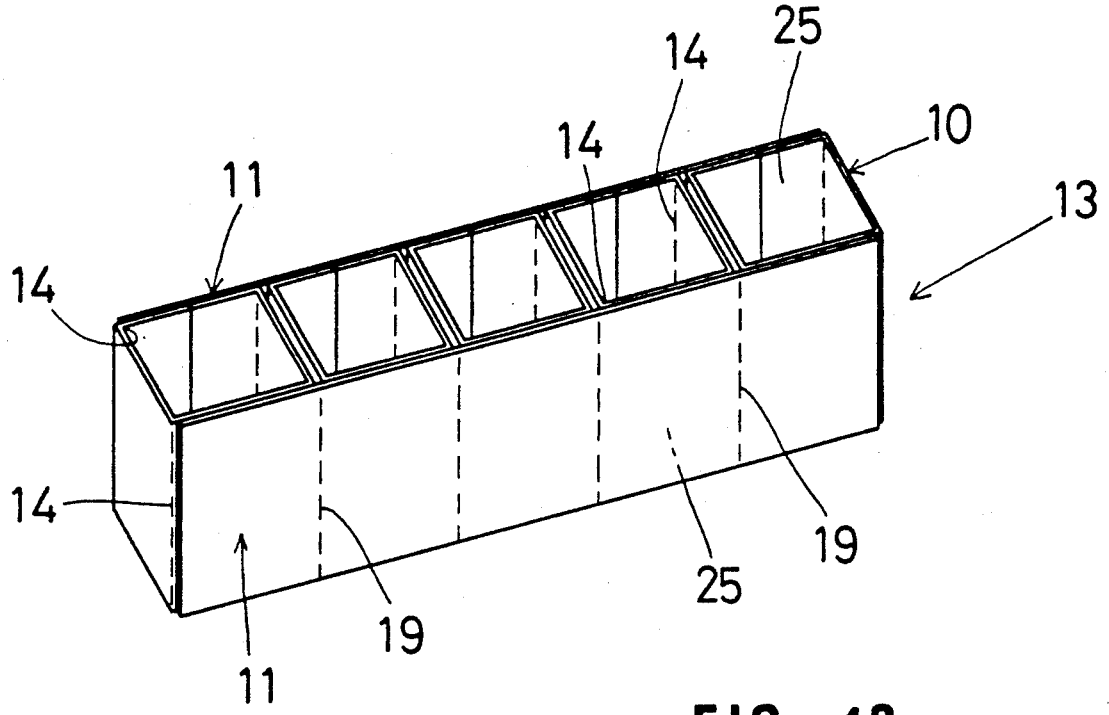
FIG. 12 is a perspective view of a collective packing box body of the third embodiment.
Figure 13:
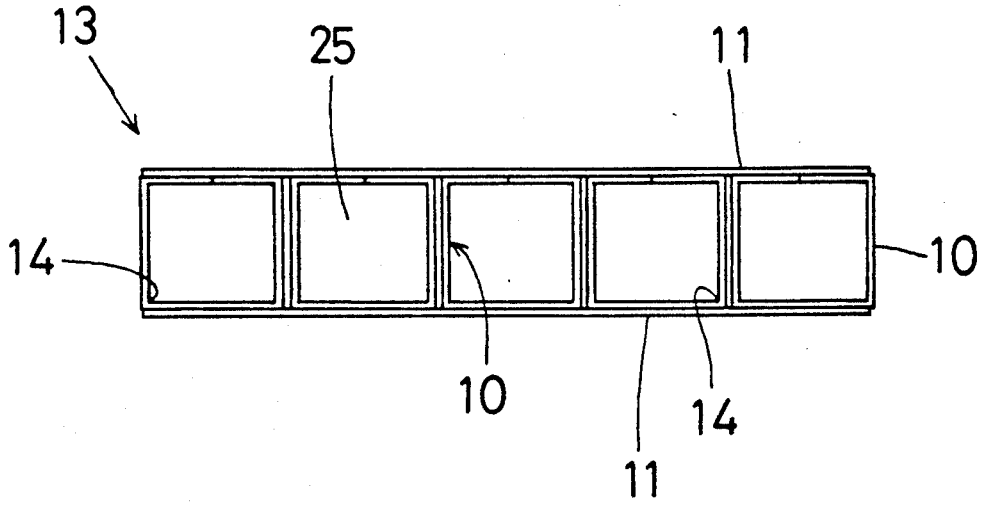
FIG. 13 is a plan view of the collective packing box body of FIG. 13.
Figure 14:
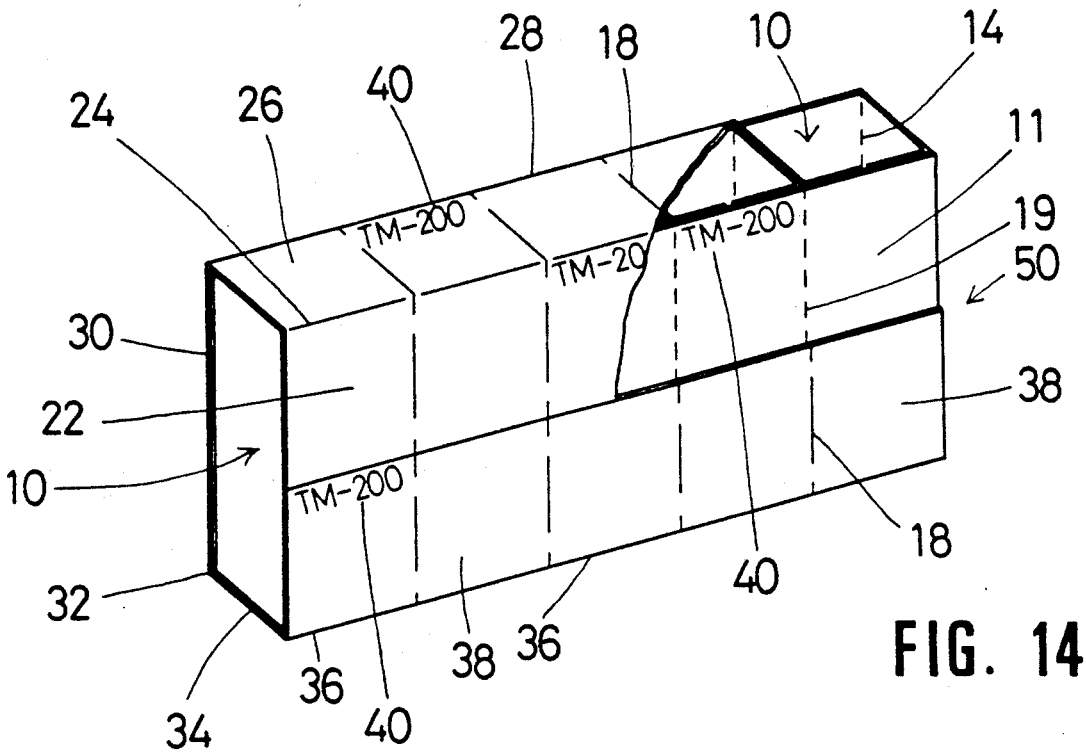
FIG. 14 is a perspective view of a fourth embodiment of a collective packing box according to the present invention.
Figure 15:
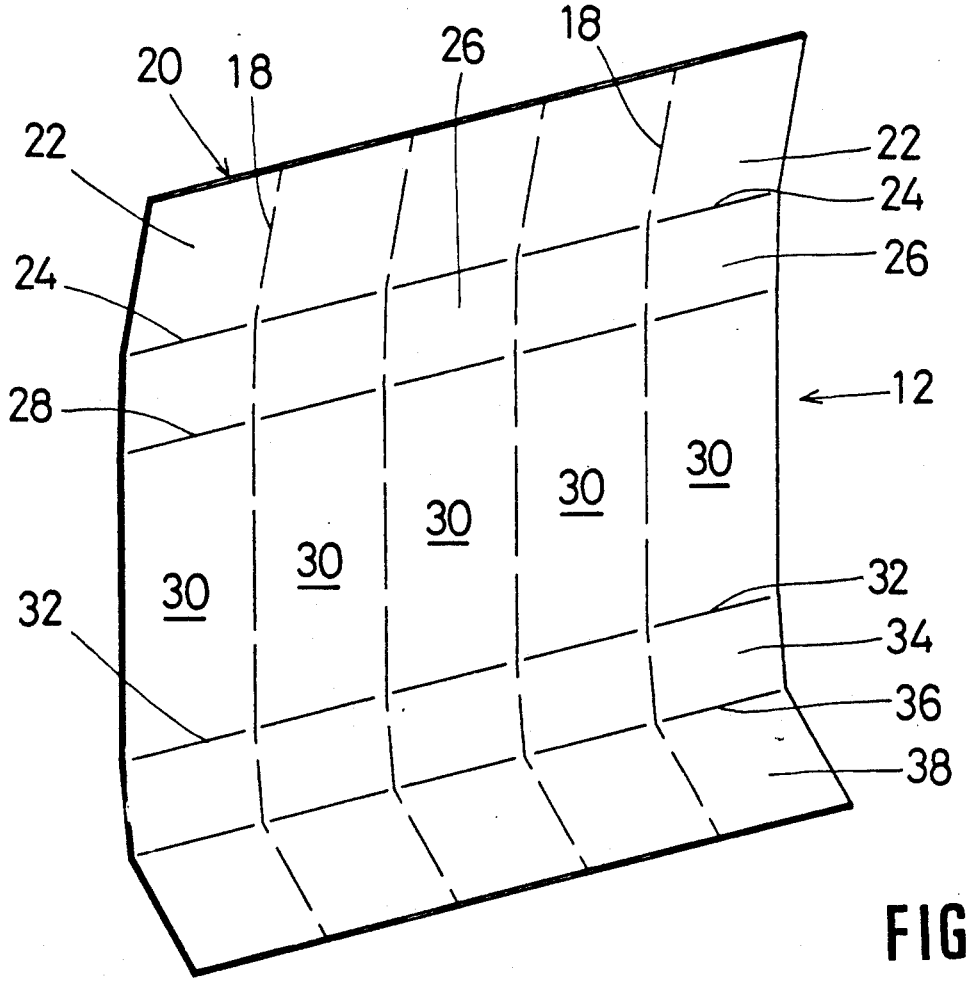
FIG. 15 is a perspective view of a cover of the fourth embodiment.

The unit packing box bodies 10 as illustrated in FIG. 12 are connected as spaced apart by slight intervals therebetween which is advantageous to create a shock absorbing characteristic of the collective packing box body 13 when the goods to be packed are accommodated in each unit packing box body 10. It is, however, to be understood that such intervals need not necessarily be provided in the present invention.

The manner in which the collective packing box body 13 is assembled with the cover 12 will now be described.

One side of the collective packing box body 13 is adhered to connecting portions 30 of the cover 12.

In this case, each unit packing box body 10 constituting each component of the collective packing box body 13 is associated with a respective connecting portion 30 of the cover 12.

Thereafter, the covering portions 34 of the cover 12 are bent toward respective ones of the openings 25 of the unit packing box bodies 10, and the marginal portions 38 are adhered to one side of a base sheet 11 which is adhered to the outside of the unit packing box bodies 10.

Each of the goods to be packed 48 is accommodated within a respective unit packing box body 10 and the covering portions 26 of the cover 12 are bent toward the other respective ones of the openings 25 of the unit packing box bodies 10, and the marginal portions 22 are adhered to the other side of the base sheet 11 of the collective packing box body 13.

As in the first embodiment, indicating portions whereat the specification of the goods to be packed 48 appear can be provided.

A fourth embodiment will be described with reference to FIGS. 14 to 17.

The fourth embodiment is substantially the same as the third embodiment.

The cover 12 is substantially the same as those of the first and third embodiments and the structure of the unit packing box bodies 10 is the same as that of the first embodiment (refer to FIG. 4).

With respect to the fourth embodiment, inasmuch as the structure of a collecting packing box body 15 is similar to that of the collective packing box body 13 of the third embodiment, a detailed description thereof will be omitted.

Figure 16:
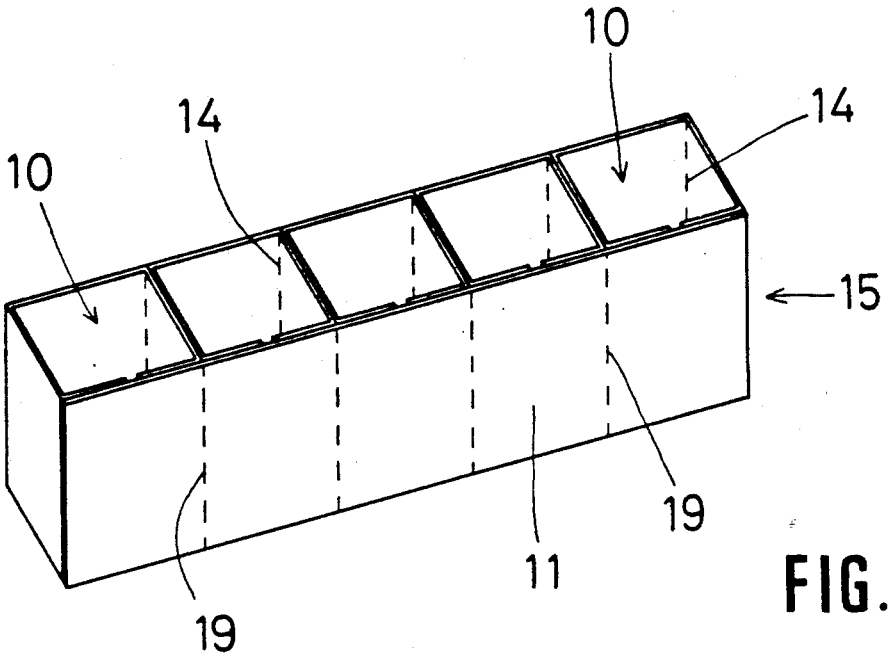
FIG. 16 is a perspective view of a collective packing box body of the fourth embodiment.
Figure 17:
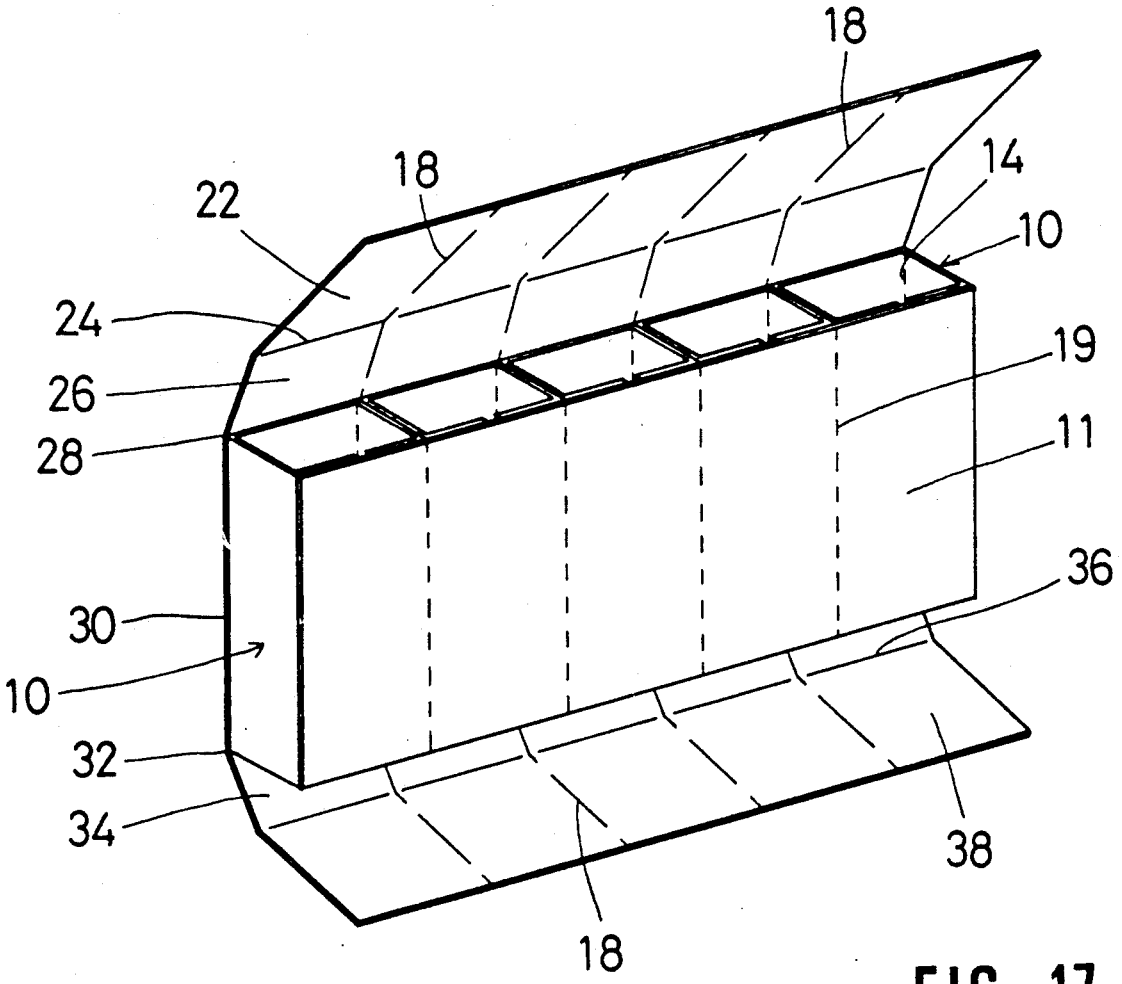
FIG. 17 is a perspective view showing a state in which the unit packing box bodies are combined with the cover in the fourth embodiment.

Although base sheets 11 are respectively adhered to opposite sides of the unit packing box bodies 10 according to the collecting packing box body 13 of the third embodiment, only one base sheet 11 is adhered to one side of the unit packing box bodies 10 disposed in parallel as illustrated in FIG. 16 and 17 of this embodiment.

More specifically, the base sheet 11 is adhered to the sides of the unit packing box bodies 10 which define confronting edges of each of the boxes 10, respectively. The other sides of the unit packing box bodies 10 do not have a sheet 11 adhered thereto.

The base sheet 11 of course has separating means 19 as in the third embodiment.

The manner in which the cover 12 is assembled with the collective packing box body 15 will now be described.

The sides which do not have the base sheet 11 adhered thereto are adhered to the connecting portions 30 of the cover 12.

The covering portions 34 of the cover 12 are bent toward respective ones of the openings 25 of the unit packing box bodies 10, and the marginal portions 38 are adhered to the base sheet 11 of the collective packing box body 15 in the same way as in the other embodiments.

The goods to be packed are each accommodated within a respective unit packing box body 10 constituting the collective packing box body 15, the covering portions 26 of the cover 12 are bent toward the respective other ones of the openings 26 of the unit packing box bodies 10, and the marginal portions 22 are adhered to the base sheet 11.

Of course, as in the other embodiments, indicating portions 40 may be provided.

The embodiments of the present invention provide the following advantages.

When supplying like goods to users, each to be packed in one of many packing boxes, it was necessary that the goods be packed temporarily in newspaper or other secondary packing material since it is generally unknown to the supplier how many of the goods supplied will be packed by the user.

On the other hand, since it is possible to separate the collective packing box into individual units along the separating means according to the prevent invention, it is suitable to pack the goods in each unit without the need for secondary packing material.

The present invention has been described with respect to preferred embodiments thereof. However, various changes and modifications will become apparent to those of ordinary skill in the art. Such changes and modification are thus seen to constitute the true spirit and scope of the invention as defined by the appended claims.

What is claimed is:

1. A collective packing box comprising:

a group of tubular unit packing box bodies each having a plurality of sides defining two opposite parallel outer surfaces, and each of the tubular unit packing box bodies having an opening at one end thereof and an opening at the other end thereof;

a base sheet adhered to each of said two parallel outer surfaces of the tubular packing box bodies and having separating means for facilitating separation of the base sheet disposed over each of said two parallel outer surfaces into a plurality of sections;

a cover comprising a plurality of demarcating sections corresponding to the number of the tubular packing box bodies in said group, and separating means provided between adjacent ones of said demarcating sections for facilitating separation of said demarcating sections from one another, each of said demarcating sections defining a connecting portion at the center thereof, a bottom covering portion provided to one side of the connecting portion, a marginal portion disposed to the side of the bottom covering portion opposite said connecting portion, a top covering portion provided to the other side of the connecting portion, and a marginal portion disposed to the side of the top covering portion opposite said connecting portion; and each said connecting portion being disposed over the base sheet adhered to one of said two parallel outer surfaces and overlying and fixed to one of the tubular unit packing bodies, each of said separating means being located between a respective pair of adjacent ones of said tubular unit packing box bodies, and said bottom covering portion provided to one side of the respective said connecting portion being inclined thereto and covering the opening at said other end of said one of the tubular unit packing box bodies, and the marginal portion disposed to the side of said bottom covering portion that covers said opening being disposed over the base sheet adhered to the other of said two parallel outer surfaces and overlying and fixed to said one of the tubular unit packing bodies.

2. A collective packing box as claimed in claim 1, wherein respective goods are disposed within each of said tubular packing box bodies, said top covering portion provided to one side of the respective said connecting portion is inclined thereto and covers the opening at said one end of said one of the tubular unit packing box bodies, and the marginal portion disposed to the side of said top covering portion that covers said opening is disposed over said base sheet adhered to the other of said two parallel outer surfaces and overlies and is fixed to said one of the tubular packing bodies.

3. A collective packing box comprising:

a group of tubular unit packing box bodies each having a plurality of sides defining two opposite parallel outer surfaces, and each of the tubular unit packing box bodies having an opening at one end thereof and an opening at the other end thereof;

a base sheet adhered to one of said two parallel outer surfaces of the tubular packing box bodies, and having separating means for facilitating the separation of the base sheet into a plurality of sections;

a cover comprising a plurality of demarcating sections corresponding to the number of the tubular packing box bodies in said group, and separating means provided between adjacent ones of said demarcating sections for facilitating separation of said demarcating sections from one another, each of said demarcating sections defining a connecting portion at the center thereof, a bottom covering portion provided to one side of the connecting portion, a marginal portion disposed to the side of the bottom covering portion opposite said connecting portion, a top covering portion provided to the other side of the connecting portion, and a marginal portion disposed to the side of the top covering portion opposite said connecting portion; and each said connecting portion being disposed over the base sheet adhered to one of said two parallel outer surfaces and overlying and fixed to one of the tubular unit packing bodies, each of said separating means being located between a respective pair of adjacent ones of said tubular unit packing box bodies, and said bottom covering portion provided to one side of the respective said connecting portion being inclined thereto and covering the opening at said other end of said one of the tubular unit packing box bodies, and the marginal portion disposed to the side of said bottom covering portion that covers said opening being adhered to the other of said two parallel outer surfaces.

4. A collective packing box as claimed in claim 3, wherein respective goods are disposed within each of said tubular packing box bodies, said top covering portion provided to one side of the respective said connecting portion is inclined thereto and covers the opening at said one end of said one of the tubular unit packing box bodies, and the marginal portion disposed to the side of said top covering portion that covers said opening is adhered to the other of said two parallel outer surfaces.

* * * * *